United States Patent [19]

Kurita et al.

[11] Patent Number: 4,923,662

[45] Date of Patent: May 8, 1990

[54] PROCESS FOR PRODUCING POLYESTER FIBERS

[75] Inventors: Kazuo Kurita; Yoshihiko Teramoto, both of Ootsu, Japan

[73] Assignee: Toyo Boseki Kabushiki Kaisha, Osaka, Japan

[21] Appl. No.: 287,082

[22] Filed: Dec. 21, 1988

[30] Foreign Application Priority Data

Dec. 21, 1987 [JP] Japan ..... 62-324745

[51] Int. Cl.[5] ..... D01D 5/088; D01D 5/16

[52] U.S. Cl. ..... 264/178 F; 264/180; 264/210.8; 264/211.14; 264/211.15

[58] Field of Search ..... 264/210.8, 180, 178 F, 264/211.14, 211.15

[56] References Cited

U.S. PATENT DOCUMENTS

| | | | |
|---|---|---|---|
| 3,115,385 | 12/1963 | Beck | 264/178 F |
| 3,549,597 | 12/1970 | Kitson et al. | 264/178 F |
| 3,963,678 | 6/1976 | Conrad et al. | 264/178 F |
| 4,425,293 | 1/1984 | Vassilatos | 264/178 F |

FOREIGN PATENT DOCUMENTS

| | | | |
|---|---|---|---|
| 49-21257 | 5/1974 | Japan | 264/178 F |
| 53-45413 | 4/1978 | Japan | 264/178 F |
| 58-169513 | 10/1983 | Japan . | |
| 58-210590 | 12/1983 | Japan . | |

*Primary Examiner*—Hubert C. Lorin

*Attorney, Agent, or Firm*—Wenderoth, Lind & Ponack

[57] ABSTRACT

A process for producing polyester fibers having excellent tensile properties, particularly suitable as reinforcement material for tires, belts, etc., involves melt-spinning an ethylene terephthalate polyester to form highly oriented low crystalline polyester filaments which, at the state of being taken-up and prior to being drawn, having birefringence (Δn) and specific gravity (SG) within the below indicated ranges (a) and (b), and then, without winding-up, subjecting the said filaments immediately to drawing and heat treatment between the first godet rolls and second godet rolls under a draw ratio (DR) defined by the following formulas:

$$\Delta n \geqq 5SG - 6.64 \quad \text{(a)}$$

$$\Delta n \geqq 0.100 \quad \text{(b)}$$

$$2.0 \geqq DR > 1.0 \quad \text{(c)}$$

5 Claims, 4 Drawing Sheets

PROCESS FOR PRODUCING POLYESTER FIBERS

BACKGROUND OF THE INVENTION (1.) Field of the Invention

The present invention relates to a process for producing polyester fibers having excellent tensile properties.

The polyester fibers produced by the present invention are suitable for use as industrial materials, particularly as reinforcement materials for tire, belts, etc.

(2.) Description of the Prior Art

It is known from Kobunshi Ronbunshu (vol. 42, pp. 159–166, 1985) that highly oriented low specific gravity polyester fibers can be obtained by drawing at a temperature lower than the glass transition temperature of the polyester.

It is also known, according to Japanese Patent Kokai (Laid-open) No. 169513/83, that in the production of high-speed spun amorphous polyethylene terephthalate yarns for producing textured yarns, the extruded filaments are quenched in a liquid bath placed under the spinneret.

According to Japanese Patent Kokai (Laid-open) No. 210590/83, it is also known that highly oriented low specific gravity polyester filaments can be obtained by stretching, using laser beams, and that highly oriented low specific gravity polyester filaments can be improved in tensile properties by heat treatment of the filaments.

The above mentioned process, employing conventional techniques, has some disadvantages in terms of productivity, property and installing expense.

For example, in the case of the process mentioned in Kobunshi Ronbunshu, 42, 159, 1985, highly, oriented low specific gravity polyester fibers, drawn at lower temperatures than glass transition temperatures should be spun at lower speed than one in which orientation induce crystallization occurs, and required a huge drawing apparatus for industrial production. This means low productivity and high installing expense. Also the tensile property of yarn by this method is not sufficient for industrial use.

In the case of Japanese Patent Kokai (Laid-open) No. 169513/83, this method relates to a method of producing textured yarns which has high shrinkage properties. Inevitably, the tensile properties are not enough for industrial use, and also the winding speed is higher than 5000 m/min; this means very high facility expenses.

In the case of Japanese Patent Kokai (Laid-open) No. 210590/83, this process uses laser power for drawing to obtain highly oriented low specific gravity polyester filaments. The apparatus used in such process, however, requires high power and is huge, expensive and dangerous in operation. Also, according to such a process, further heat treatment is required to obtain low shrinkage properties for industrial use.

SUMMARY OF THE INVENTION

We have found that in the highly oriented low crystalline polyester filaments to be submitted for stretching in the present invention, when the filaments are once wound up, stress relaxation takes place on the winding bobbin, and there occurs a considerable difference in the yarn denier between the outer layers and inner layers of the winding bobbin. This results in that the filaments have a lower degree of orientation toward the outer layers and even after these yarns are drawn and heat-treated, the fibers obtained have lower physical properties toward the outer layers.

The object of the present invention is to solve all of the above mentioned problems and to provide a process for producing polyester fibers having improved tensile properties at high productivity by means of a compact apparatus, wherein highly oriented low specific gravity polyester filaments are produced by means of a compact apparatus at high productivity under good operation conditions, followed by drawing immediately without winding up.

Briefly, the present invention is a process for the production of polyester fibers which comprises melt-spinning a polyethylene terephthalate to form highly oriented low crystalline filaments which, at the stage of spun filament, have a birefringence ($\Delta n$) and specific gravity (SG) within the below indicated ranges (a) and (b), and then, without winding-up, subjecting the said filaments immediately to drawing and heat treatment between the first godet rolls and second godet rolls under a draw ratio (DR) defined by the following formulas:

$$\Delta n \geqq 5SG - 6.64 \quad \text{(a)}$$

$$\Delta n \geqq 0.100 \quad \text{(b)}$$

$$2.0 \geqq DRA > 1.0 \quad \text{(c)}$$

BRIEF DESCRIPTION OF THE DRAWINGS

The invention will be explained in more detail by referring partly to the accompanying drawings wherein.

DETAILED DESCRIPTION OF THE INVENTION

The present invention is characterized in that such novel polyester filaments, more particularly polyester filaments which are extremely highly oriented but have low crystalline structure, are immediately drawn after spinning, without being wound-up.

It has been known that polyester fibers have, for example, a high degree of crystallinity, a high melting point, and excellent properties in respect to heat resistance, chemical resistance, light resistance and strength. On the other hand, polyester fibers, which are highly oriented but have very low crystallinity are extremely rare.

The polyesters which form the polyester filaments of the present invention are composed mainly of ethylene terephthalate units, and they are usually polyesters containing 85 mol % or more of ethylene terephthalate units, or homopolyesters, or mixtures of these polyesters. Among copolymeric components other than terephthalic acid and ethylene glycol, there may be mentioned isophthalic acid, 2,6-naphthalene dicarboxylic acid, adipic acid, sebatic acid, oxalic acid, diethylene glycol, propylene glycol, cyclohexane dimethanol, p-oxybenzoic acid, metal salts of 3,5-di(carbomethoxy)-benzenesulfonic acid, or derivatives of these compounds. However, they are not limited to the above mentioned specific examples.

The filaments to be submitted for drawing in the present invention satisfy the above mentioned formula (a) as to the relationship between the index of birefringence ($\Delta n$) (parameter of the degree of orientation) and specific gravity (SG) (parameter of the crystallinity) and at the same time, they satisfy the formula (b) as to the birefringence ($\Delta n$).

When the formula (a) is not satisfied, orientation-induced crystallization takes place, and therefore, highly oriented amorphous fibers cannot be obtained.

This orientation-induced crystallization can be evaluated by observing wide angle X-ray diffraction patterns of the filaments.

Figure 1:
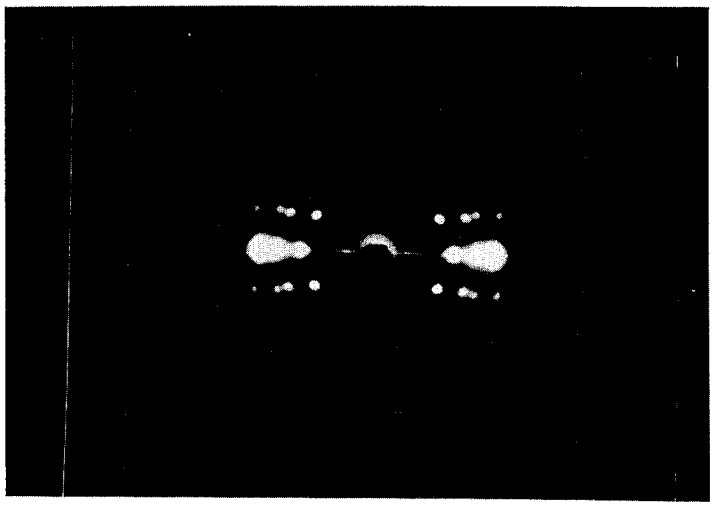
FIG. 1 is a wide angle X ray diffraction pattern of drawn polyester fibers which are oriented and crystallized.
Figure 2:
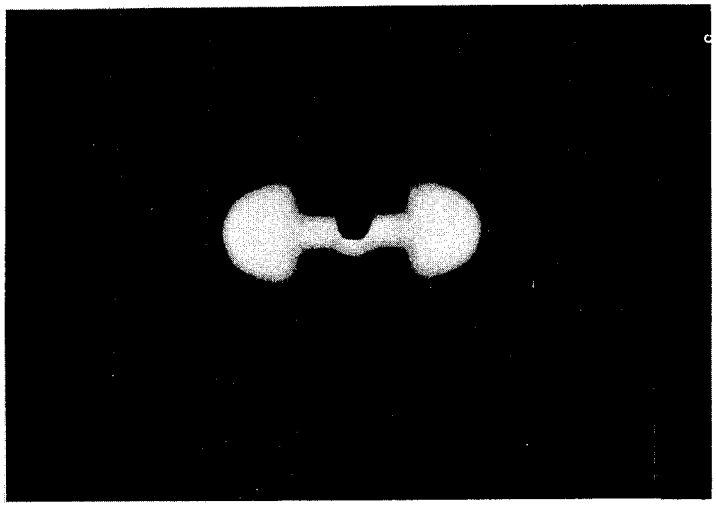
FIG. 2 is a wide angle X ray diffraction pattern of polyester fibers which are highly oriented but have an amorphous structure.

FIG. 1 is a wide angle X-ray diffraction pattern of drawn polyester fibers which are oriented and crystallized. FIG. 2 is a wide angle X-ray diffraction photograph of polyester fibers which are sufficiently oriented but have an amorphous structure.

When the formula (a) is satisfied, a pattern like FIG. 1 is not observed in the as-spun fibers, but a diffused diffraction pattern, caused by amorphous polyethylene terephthalate, like FIG. 2, is observed.

In order to produce filaments having improved tensile properties, fibers having a structure of that of the present invention must be drawn as described herein. The as-spun filaments can be easily improved as compared with conventional as-spun materials, since very small quantities of crystals in the as-spun filaments of this invention does not disturb the drawing thereof.

The birefringence ($\Delta n$) of the filaments to be submitted for drawing in the present invention satisfies the formula (b) and $\Delta n$ is preferably in the range of from $100\times10^{-3}$ to $270\times10^{-3}$.

When $\Delta n$ is lower than $10\times10^{-3}$, the drawn filaments will be inferior in mechanical properties. On the other hand, when $\Delta n$ exceeds 0.27, the mechanical properties of drawn filaments fall extremely. We are not able to fully explain the reason for this, but we conjecture that the molecular chains might be pulled out during the drawing, because the chains are subjected to excessive elongation.

The lower limit of favorable specific gravity (SG) of the filaments to be submitted for drawing in the present invention is 1.335. Filaments having a specific gravity lower than 1.335, contain voids, and the mechanical properties of such drawn filaments are extremely deteriorated and hence such filaments are not desirable. Even if filaments have an SG within the suitable range, but contain voids, such filaments are not desirable.

The filaments to be submitted for drawing in the present invention not only have high orientation and amorphous structure viewed the such $\Delta n$ and SG valves, but also are characterized in that they have little denier unevenness in the lengthwise direction of the yarn.

In the case of using a conventional method of attaining the same degree of high orientation and non-crystallinity, to attain obtaining non-oriented non-crystallized undrawn filaments, by spinning at a low speed, and the filaments are drawn without heat (cold drawing), a draw ratio far exceeding the natural draw ratio is necessary. Even if such fibers are obtained, the denier unevenness in the lengthwise direction of the yarn will be extremely large, and such fibers will be hardly worthy of practical use.

The method of cold-drawing non-oriented non-crystallized undrawn filament yarns at a natural draw ratio (NE) has been heretofore the only method of obtaining highly oriented amorphous yarns. However, the $\Delta n$ of the highly oriented amorphous yarns obtained by such a method is from 0.070 to 0.080 at highest, and yarns having a $\Delta n$ exceeding $100\times10^{-3}$ cannot be obtained.

In the filaments to be used for drawing in the present invention, the difference in orientation degree between the surface and center of a filament is remarkably larger in comparison with highly oriented amorphous filaments obtained by the ordinary drawing method. On the surface of the filaments, extremely highly oriented molecular chains exist, and this has an effect of facilitating the production of fibers of higher strength and higher modulus by drawing. To explain this in more detail, the difference in orientation between the yarn surface and yarn center is $5\times10^{-3}$ or more, preferably $10\times10^{-3}$ or more. On the other hand, by the ordinary method, it is difficult to obtain a birefringence difference of $5\times10^{-3}$ or more.

The process of the present invention will now be explained in more detail in the following paragraphs.

The filaments before drawing in the process of the present invention are obtained by melt-spinning a polyester having an intrinsic viscosity (IV) of 0.8 or more, of which the major chemical units are ethylene terephthalate units, quenching the spun filaments with a liquid cooling apparatus in tubular form, while satisfying special cooling specifications, controlling the relationship between the polymer extrusion velocity and the take-up velocity of the filaments, and then taking-up the filaments at a high speed.

In the case of using an ethylene terephthalate polyester having an intrinsic viscosity (IV) less than 0.8, it becomes impossible to stably produce highly oriented non-crystalline filaments at a take-up speed of less than 5000 m/min., while satisfying the formula (a) and formula (b), and therefore such a process is hardly worthy of practical use from an industrial viewpoint. There is used therefore a polyester having an IV higher than 0.8, preferably higher than 1.0.

Figure 3:
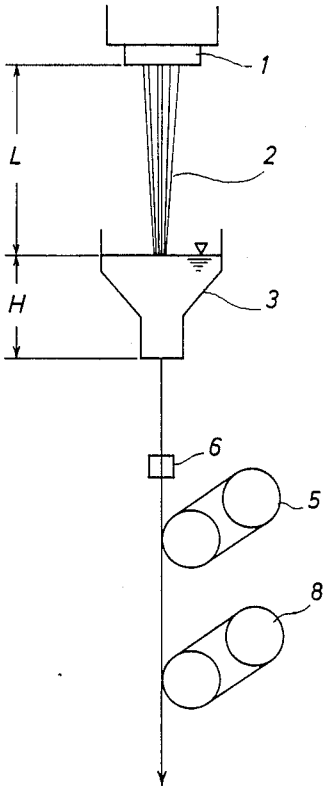
FIG. 3 is a rough schema showing the production process of the present invention.
Figure 5:
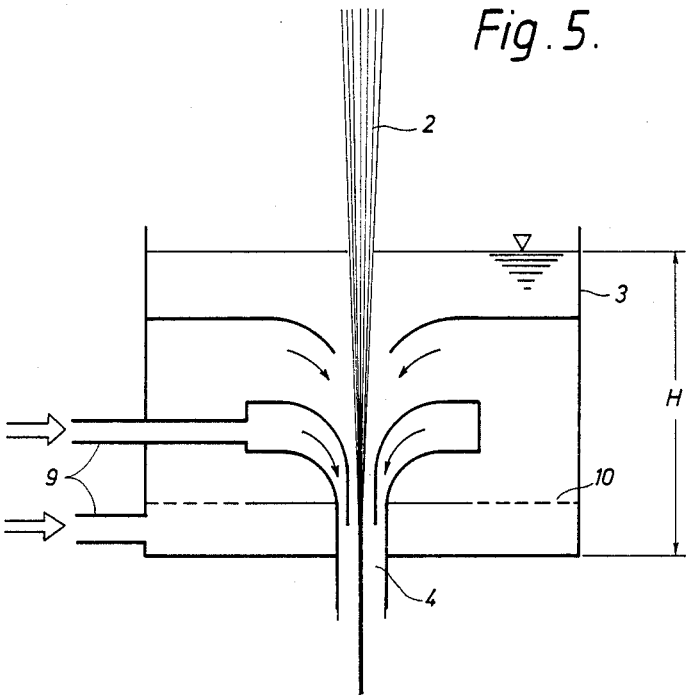
FIG. 5 is the cross-section of a liquid cooling apparatus used in the practice of the present invention.
Figure 6:
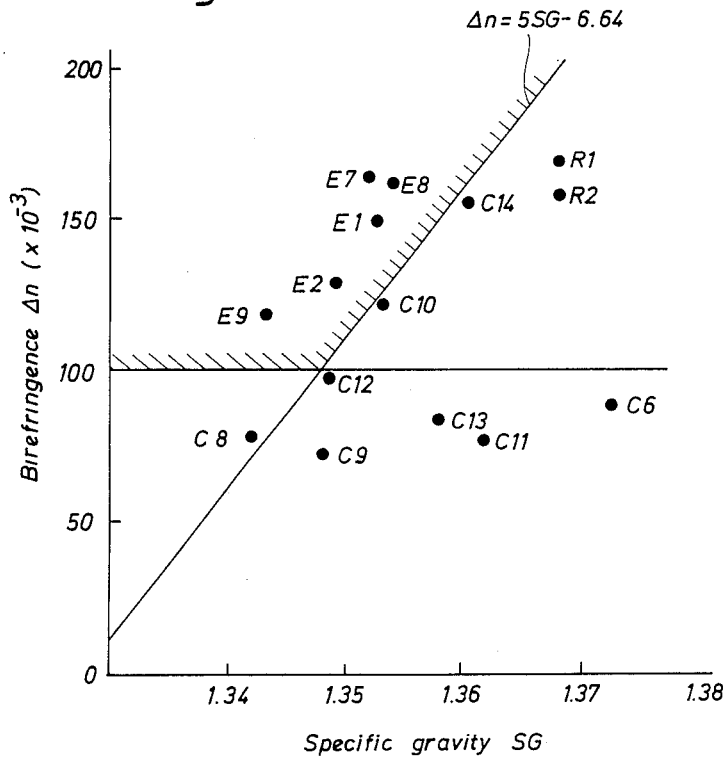
FIG. 6 shows the relationship between the birefringence and specific gravity of the as-spun filaments in the Examples, Reference Examples and Comparative Examples, and in the Figure, E, R and C respectively means Examples, Reference Example and Comparative Examples.
Figure 7:
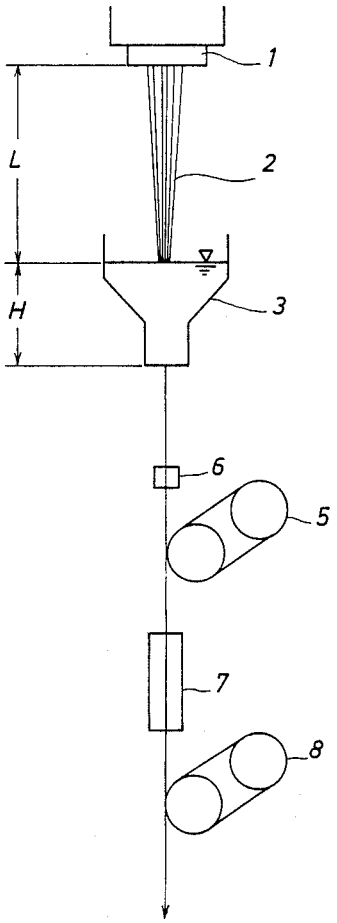
FIG. 7 is a schematic drawing of the spin-draw process of the present invention.

The cooling apparatus used herein is indicated by 3 in FIG. 3 or FIG. 7, and the structure is, for example, that shown in FIG. 5. Incidentally, in FIG. 3 and FIG. 7, 1 is a spinneret, 2 is spun filaments, 3 is a liquid cooling apparatus (liquid quenching tube), 5 is the first godet rolls, 6 is an oil applying apparatus, 7 is a heating zone, and 8 is second godet rolls. In FIG. 5, 4 is an opening for flowing down the liquid, 9 is inlets for the cooling liquid, and 10 is a rectifying screen. The cooling liquid used is an ordinary water.

In the following paragraphs of the present invention, the liquid cooling apparatus is sometimes referred to as a liquid quenching tube.

The liquid quenching tube 3 is characterized in that the cooling liquid flows in the direction of passage of the filaments 2, and is so designed that the flow velocity will vary according to the distance from the liquid surface. To explain in detail, by permitting the liquid at the inlet of the quenching tube to flow extremely slowly, it is possible to prevent mutual fusion of the filaments at or near the air-liquid interface.

In the present invention, it is important to satisfy all of the following process requirements (1)–(5), upon taking-up of the melt-spun filaments.

(1) The distance L (cm) between the spinneret 1 and the liquid surface of the liquid cooling apparatus 3 $\leqq$ filament solidification point $-5$, wherein the filament solidification point is a value determined by filament diameter measurement according to on-line measurement of filament diameter change of filaments spun under the air quenching conditions of 20° C., 65% RH, 0.3 m/sec.

(2) The liquid flow down velocity (m/min.) at the lower end of the liquid cooling apparatus 3 $\geqq V_w/60$, wherein $V_w$ is the take-up velocity (m/min.) of the filaments.

(3) The take-up velocity $V_w$ (m/min.) $\geqq V_o \times 200$, wherein $V_o$ is the extrusion velocity (m/min.) of the polyester from the spinneret 1.

(4) The vertical distance H (cm) from the liquid surface of the liquid cooling apparatus to the bottom of the liquid $\geqq 5$ cm.

(5) The liquid temperature of the liquid cooling apparatus $\leqq 50°$ C.

The reasons for the necessity of satisfying the requirements (1) to (5) are as follows:

(1): In order to suppress crystallization and to decrease the specific gravity, the distance L between the spinneret 1 and the quenching tube 3 must be brought close towards the spinneret at least 5 cm from the filament solidification point. As used herein the term "filament solidification point" means the point where the solidification of filaments occurs when the filaments are taken-up at a velocity of $V_w$ without providing a liquid quenching tube. If the quenching tube 3 is placed farther than the above mentioned position from the spinneret 1, orientation-induced crystallization will take place at parts of the filaments 2 higher than the quenching tube 3, and thus the object of the present invention can not be attained.

For decreasing denier unevenness in the lengthwise direction, it is desirable to slowly cool the space between the spinneret 1 and the liquid cooling apparatus 3 with a gas such as air.

(2): It is desirable to bring the liquid flow down velocity at the downstream end of the qluenching tube 3 to more than 1/60 of the take-up velocity $V_w$. When the liquid flow down velocity is lower than this, the tension of the filaments 2 between the lower end of the quenching tube 3 and the rolls 5 becomes large, and excessive drawing stress is exerted. Thus, damage to the filament quality occurs, such as filamentation and yarn breakage.

(3): The take-up speed ($V_w$) must be $V_0 \times 200$ or more, in order to increase the orientation, wherein $V_0$ is the polymer extrusion velocity from the spinneret 1. When the take-up speed is lower than $V_0 \times 200$, it is difficult by the method of the present invention to obtain filaments whose $\Delta n$ is higher than $100 \times 10^{-3}$.

(4): In order to decrease the liquid flow at or near the liquid surface of the quenching tube 3 and to bring the liquid flow down velocity at the lower end of the quenching tube 3 to $V_w/60$ or more, the length of the quenching tube 3, that is, the vertical distance H from the liquid surface to the liquid bottom of the liquid cooling apparatus 3, must be 5 cm or more. With an apparatus shorter than this, a spin-like whirl generated by the liquid flow down at the quenching tube 3 reaches the surface of the cooling bath. This is a cause of mutual fusion of the filaments and denier unevenness of the filaments.

(5): The temperature of the cooling liquid in the quenching tube 3 must be 50° C. or less. If the liquid temperature becomes higher than this, the cooling power will lowered, and although the orientation of the filaments becomes higher, crystallization will proceed. Thus the object of the present invention cannot be attained.

The crystallization of terephthalate polyester proceeds from its molten state to its cooled and solidified state. By the process of the present invention, the staying time of the polymer in the temperature range in which crystallization takes place, can be shortened to a large extent, by quenching with a quenching tube, during the time in which the filaments are cooled in the melt-spinning process of which the temperature is lower than the melting point $T_m$ and higher than glass transition temperature $T_g$. We believe that, in the present invention, filament yarns of low crystallinity can be produced by thus shortening the staying time of the polymer in said temperature range.

The highly oriented low crystalline polyester filaments thus produced, without once being wound up, are drawn and heat-treated between the first godet rolls 5 and second godet rolls 8 at a draw ratio (DR) shown in the formula below and wound up, whereby the filaments are improved in tensile properties, that is, given improved strength and improved modulus.

$$2.0 \geqq DR > 1.0 \qquad \text{(c)}$$

If the highly oriented low crystalline polyester filaments used in the present invention are once wound up without being immediately subjected to draw-heat treatment, remarkable relaxation of orientation occurs, on the winding bobbin. Since a further draw-heat treatment will give impart sufficient improvements, it is necessary to immediately subject the filaments to draw-heat treatment, without once winding up the filaments.

At the time when the filaments are spun and immediately subjected to a draw-heat treatment without being once wound up, it is necessary that the draw ratio (DR) should be 2 or less and larger than 1.

When the draw ratio exceeds 2, even if such drawing is possible, much filamentation will occur, and thus the improving effect of the tensile properties will be lowered.

If the draw ratio is less than 1, relaxation of orientation occurs and the improvement of the tensile properties is be lowered, and the draw ratio must be therefore 2 or less and larger than 1.

The drawing temperature must be so determined that the practical drawing temperature is in the range of from 150° C. to 260° C., preferably from 210° C. to 250° C.

Furthermore, subsequent to the draw-heat treatment, the filaments are preferably subjected to a relaxation treatment at a relaxation ratio of 15% or less between the second godet rolls 8 and third godet rolls. When the relaxation treatment is not conducted, quality fluctuation is liable to occur, and in particular, when the winding amount per bobbin is large, it causes a serious problem in terms of package shape.

Although the heating method in the draw-heat treatment is not particularly limited, it is preferable to provide a heating zone 7, between the first godet rolls 5 and the second godet rolls, particularly a heating zone in which steam is used as the medium.

At this time, the temperature of the first godet rolls is preferably higher than 5° C. and lower than 60° C.

When the temperature of the first godet rolls is higher than 60° C., the highly oriented low crystalline polyester filaments obtained by spinning will crystallize easily, and thus the drawability will be remarkably impaired. Hence in the draw-heat treatment of the present invention, it is most desirable to provide a heating zone 7 between the first godet rolls 5 and the second godet rolls 8.

On the other hand, when the temperature of the first godet rolls 5 is less than 5° C., dew condensation will occur on the roll surface and thereabout, and therefore the operability will be seriously aggravated. When providing the heating zone 7 between the first godet rolls 5 and the second godet rolls 8, it is most desirable, from the viewpoint of cost maintenance, to use high temperature steam (super-heating steam) as the heating medium.

Thus, the important and novel feature of the present invention is to first produce polyester filaments having the particular birefringence and specific gravity as mentioned before by melt-spinning and, without winding-up, and to subject the resulting filaments immediately to drawing under the particular conditions to produce polyester fibers having excellent properties. Except for these features and conditions, the production of the polyester fibers can be conducted in a conventional manner and with a conventional apparatus known per se for the production of polyester fibers.

In the following paragraphs, Examples of the present invention will be shown, but the invention is by no means limited to these Examples.

Incidentally, the methods of measuring the physical properties used for the evaluation of the present invention are as follows:

Measurement of the birefringence ($\Delta n$):

Measurement was effected by the use of a Nikon polarization microscope (POH type) with a Berek compensator manufactured by Leitz. For the light source, there was used an apparatus for generating an Na D-line, manufactured by Toshiba (Toshiba SLS-3-B). A specimen, cut at an angle of Ca. 45° to the fiber axis, of 5 to 6 cm long was placed on a slide glass, with an upward cut surface. The slide glass was placed on a rotatable stand, and the stand was rotated so as to make an angle of 45° between the specimen and the polarizer. An analyzer was inserted to make a dark field, the compensator was adjusted to 30, and the number of fringe patterns (n) was counted. The compensator was rotated clockwise and the scale (a) at which the specimen first became darkest was read. Then, the compensator was rotated counterclockwise, and the scale (b) at which the specimen first became darkest was read. The compensator was returned to 30, the analyzer was taken off, and the diameter of the specimen (d) was measured. The index of birefringence ($\Delta n$) was calculated according to the following equation (average of 20 measured values):

$$\Delta n = \Gamma / d$$

wherein $\Gamma$ (retardation) $= n\lambda_o + E$ $\lambda_o = 589.3$ m$\mu$ $\epsilon$ is obtained from C/10000 and i in the Leitz's explanatory manual of the compensator, i being a−b (i.e. the difference in the readings of the compensator).

Measurement of specific gravity:

A density gradient tube composed of n-heptane and carbon tetrachloride was prepared, and the tube was regulated to a temperature of 30° C.±0.1° C. A sufficiently defoamed specimen was placed in the tube. After allowing the tube to stand for 5 hours, the position of the specimen in the tube was read by the scale of the tube, and the value obtained was converted into specific gravity from the calibration graph of (density gradient tube scale)−(specific gravity), scaled according to a standard glass float. The measurement was repeated 4 times (n=4). As a rule, the specific gravity values were read to the fourth decimal place.

Measurement of the distribution of $\Delta n$ in filament section:

From the refractive index at the center ($n_{\perp,0}$ and $n_{\parallel,0}$) and the refractive index at the outer layer ($n_{\perp,0.9}$ and $n_{\parallel,0.9}$) measured by the use of an interference the specific molecular orientation of the filaments of the present invention is made clear, and the relationship between the filament and its excellent strength can be shown. According to the interference fringe method using an interference microscope (for example an interference microscope "Interfaco" produced by Carl Zeiss Jena of East Germany), the distribution of the average refractive index observed from the side of the filament can be measured. This method is applicable to a filament having a circular section. The refractive index of the filament is characterized by the refractive index ($n_{\parallel}$) to the polarization vibrating in parallel with the filament axis and the refractive index ($n_{\perp}$) to the polarization vibration perpendicular to the filament axis. Measurements as hereinafter explained are all carried out with the refractive indexes ($n_{\parallel}$ and $n_{\perp}$) obtained by the use of a xenon lamp as the light source and a green color beam ($\lambda$=544 nm) through an interference filter under polarization.

Figure 4A:
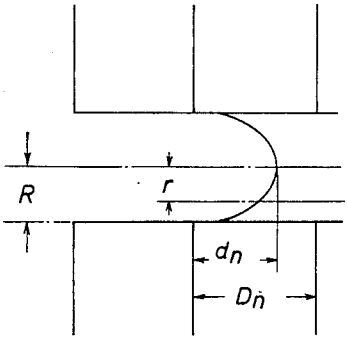
FIG. 4(A) is a schematic drawing showing interference fringes of spun filaments in the present invention as seen through an interference microscope.
Figure 4B:
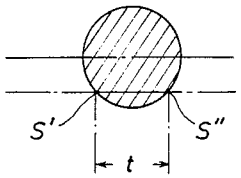
FIG. 4(B) is a schematic drawing of a cross-section of the filament in FIG. 4(A).

In the following, $n_{\parallel,0}$ and $n_{\perp,0.9}$ obtainable from the measurement of $n_{\parallel}$ and $n_{\perp}$ will be explained in detail. The filament to be tested for $n_{\perp}$ ($n_{\perp,0}$ and $n_{\perp,0.9}$) is immersed in a immersion liquid having a refractive index ($n_E$) which will produce a retardation of the interference fringe within a dn/Dn of 0.2 to 1 (in FIG. 4). The refractive index of the immersion liquid ($n_E$) indicates the value measured by the use of an Abbe refractometer at 20§C. The immersion liquid may be, for instance, a mixture of liquid paraffin and $\alpha$-bromonaphthalene, having a refractive index of 1.48 to 1.65. A single filament of the filaments is immersed in the immersion liquid, and the pattern of the interference fringe is photographed. The resulting photograph is enlarged to 1,000 to 2,000 magnification and is subjected to analysis. As schematically shown in FIG. 4, the light path difference L can be represented by the following equation:

$$L = dn/Dn\lambda = (n_f - n_E)t$$

wherein $n_E$ is the refractive index of the immersion liquid, $n_f$ is the average refractive index between S' and S'' of the filament, t is the thickness between S' and S'', $\lambda$ is the wave length of the light used, Dn is the interval between the parallel interference fringes of the background (corresponding to 1λ), and dn is the retardation in the interference fringe caused by the filament.

The pattern of interference fringe is evaluated using two different immersion liquids having the following refractive indexes ($n_1$, $n_2$).

$$n_f < n_1$$

$$n_f > n_2$$

wherein $n_f$ is the refractive index of the specimen.

Thus, the light path differences ($L_1$, $L_2$) in the case using the different immersion liquids having the refractive indexes $n_1$ and $n_2$ are represented by the following equations:

$$L_1 = \frac{d_1}{D_1}\lambda = (n_f - n_1)t \quad (5)$$

$$L_2 = \frac{d_2}{D_2}\lambda = (n_f - n_2)t$$

$$n_f = \frac{L_1 n_2 - L_2 n_1}{R_1 - R_2}$$

Therefore, the distribution of the average refraction index ($n_f$) of the filament in various positions from the center to outer layer of the filament can be obtained from the light path difference at those positions according to the equation (5). Due to any variation of the conditions on the manufacture or any accident after the manufacture, the filament may have any non-circular section. In order to avoid the inconvenience caused by such section, measurement should be made for the parts where the interference fringe is symmetric to the filament axis. Measurement is effected with intervals of 0.1 R between 0 and 0.9 R being the radius of the filament, and the average refractive index at such position is obtained. Therefore, the distribution of $n_{\parallel}$ and $n_{\perp}$ can be obtained, and therefore the distribution of birefringence can be obtained according to the following equation:

$$\Delta n_{(r/R)} = n_{\parallel,r/R} - n_{\perp,r/R} \quad (6)$$

The value $\Delta n_{(r/R)}$ indicates an average on at least three filaments, preferably 5 to 10 filaments.

Measurement of intrinsic viscosity (IV):

The intrinsic viscosity (IV) of an ethylene terephthalate polyester in the present invention is obtained by converting the intrinsic viscosity (η) measured with a mixed solvent of p-chlorophenol/tetrachloroethane in the ratio of 3/1 at 30° C. into the intrinsic viscosity (IV) measured with a mixed solvent of phenol/tetrachloroethane in the ratio of 60/40, according to the following equation:

$$IV = 0.8325 \times (\eta) + 0.005$$

Measurement of the solidification point of the filaments:

The solidification point is the position where the thinning of the filaments is terminated due to their solidification.

The thinning behavior of running filaments was measured by a Diameter Monitor by irradiating a beam of infrared ray to the filaments, and the quantity of the shadow of the filaments is measured by a light receiving sensor. The quantity is then converted to the diameter.

By passing a single filament selected from the running filaments through a detector of the Diameter Monitor, the filament diameter at this position can be easily obtained. The solidification point can be clearly determined by plotting the relationship between the distance of the filament from the spinneret and the filament diameter.

Measurement of filament denier:

The single filament denier (d) was measured in a test room of a standard condition (20° C.±2° C.; RH 65±2%) by using a denier measuring apparatus DENIER COMPUTER DC-11, B-TYPE, produced by Search Co. The length of the filament length for testing was 50 mm.

Measurement of the strength of the filaments:

The tensile strength (tenacity) of the filaments was measured for a tensile strength of a single filament, according to JIS-L-1013 (1981) 7.5.1, in a test room of standard condition, by using an INSTRON-type tensile testing machine TENSILON UTM-III produced by Toyo Baldwin Co.

The specimen was drawn under measuring conditions of a load cell of 5 kg f, with the distance between jaws being 3 cm, a elongation velocity of 3 cm/min (a strain rate per minute is 100%), and a delivery velocity of recording paper of 100 cm/min. The load (gf) at which the specimen was broken was measured, and the tenacity (g/d) was calculated according to the following equation.

$$\text{Tenacity } (g/d) = \frac{\text{Strength at break } (gf)}{\text{Denier } (d) \text{ of the specimen}}$$

Measurement of the initial tensile modulus of the filaments:

The measurement of the initial tensile modulus of the filaments was made in the same way as the above-mentioned measurement of the strength of the filaments, according to JIS-L-1013 (1981) 7.5.1. A load-elongation curve (stress-strain curve) was drawn on recording paper, and from this curve and according to the initial tensile modulus calculating formula mentioned in JIS-L-1013 (1981) 7.10, the initial tensile modulus (g/d) was calculated.

EXAMPLE 1

A polyethylene terephthalate having an intrinsic viscosity (IV) of 1.0 was extruded at a spinning temperature of 310° C. through a spinneret having 24 spinning orifices and an orifice diameter of 0.4 mm, at a throughput of 1.5 g/min per orifice, and an extrusion velocity ($V_0$) of 11.4 m/min. The solidification point of the filaments was 48 cm from the spinneret. The extruded filaments were introduced into the quenching tube shown in FIG. 5. In the figure, 4 is the flow down opening for the quenching liquid, 6 is inlets for the cooling liquid, and 7 is a rectifying screen. The flow of the liquid from the surface of the quenching tube to 5 cm downward therefrom was kept in a gentle state by another rectifying screen 10. The height (H) of the liquid in the quenching tube was fixed at 25 cm. At the lower end of the quenching tube, i.e. 25 cm downstream from the surface, the liquid flow velocity in the flow down direction was regulated so as to be 2,000 m/min. The length (L) from the orifice surface of the spinneret to the liquid surface of the quenching tube was set at 36 cm. The cooling liquid used was water of room temperature (25° C.).

The Δn and the specific gravity of the thus obtained yarn was $150\times10^{-3}$ and 1.3528, respectively. As regards the distribution of the birefringence in the cross section of the yarn, the Δn on the surface was found to be by $15\times10^{-3}$ larger than that of the center of the yarn.

EXAMPLE 2

The filaments were produced in the same spinning and quenching conditions as in Example 1 except that the take-up speed ($V_w$) was 3300 m/min. The solidification point of the filaments was 62 cm from the spinneret. The Δn and the specific gravity of the thus-obtained yarn was $129\times10^{-3}$ and 1.3492, respectively.

EXAMPLE 3

The filaments obtained in Example 1, without being wound, were subjected to a drawing treatment of 1.31 times by means of the apparatus shown in FIG. 7, between the first godet rolls 5 and second godet rolls 8, using a steam heater of 245° C., and the filament were wound. Thus, there was obtained a drawn yarn having the characteristics shown in the column of Example 3 of Table 1.

COMPARATIVE EXAMPLES 1-5

On the other hand, the filaments obtained in Example 1 were once wound (winding time: 20 minutes), and were allowed to stand for 24 hours in an atmosphere of 22° C. and 65% RH. Thereafter, from the undermost layer of the bobbin toward the lengthwise direction of the filaments, the filaments were divided into 5 parts (layers), i.e. the 1st 1/5 (outermost) layer, 2nd 1/5 layer, 3rd 1/5 layer, 4th 1/5 layer, and 5th (innermost) layer, and these were respectively drawn 1.26 times, at a feed roller velocity of 100 m/min, using a slit heater of 245° C. The fiber properties thus-obtained are shown in the column of Comparative Examples 1-5 of Table 1.

As shown in Table 1, the physical properties dropped according as the position in the bobbin of the fibers proceeds toward the outer layers.

COMPARATIVE EXAMPLE 6

Filaments were obtained under the same spinning conditions as in Example 1 except that the filaments were cooled with an ordinary air quench, without using the quenching tube, and were then wound up. The filaments were drawn 1.5 times at 150° C., at a feed roller speed of 50 m/min, followed by drawing to 1.5 times at 240° C. The properties of the thus-obtained fibers are shown in the column of Comparative Example 6 of Table 1.

Incidentally, the Δn and the SG of the filaments used in Comparative Example 6, before the drawing treatment were $88.2\times10^{-3}$ and 1.3722, respectively. These data do not satisfy the formulas (a) and (b).

EXAMPLE 4 AND COMPARATIVE EXAMPLE 7

After draw-heat treatment under the same conditions as in Example 3, the filaments, without being wound, were subjected to relaxation treatment at a relaxation ratio of 3% on third godet rolls arranged subsequent to the second godet rolls, and were then wound up. In this way, there were obtained drawn fibers having the properties shown in the column of Example 4 of Table 1. In comparison with the drawn fibers obtained in Example 3, the fibers had a nice winding shape. There was no irregular wound edge of the bobbin, even after winding as much as 3 kg. On the other hand, when the relaxation ratio was 17%, there occurred a considerable slack between the second godet rolls and the third godet rolls and winding was therefore impossible.

EXAMPLE 5

The filaments obtained in Example 1, without being wound-up, were subjected to a drawing treatment of 1.29 times, in an apparatus as shown in FIG. 7, using a plate heater at a temperature of 245° C., and were then wound up to obtain drawn fibers having the properties shown in the column of Example 5 in Table 5.

EXAMPLE 6

The filaments obtained in Example 1, without being wound up, were subjected to a drawing treatment of 1.27 times, in an apparatus as shown in FIG. 7, using an electric oven at a temperature of 700° C., and were then wound up to obtain drawn fibers having the properties as shown in the column of Example 6 of Table 1.

Incidentally, the draw ratio in Example 5 or Example 6 is lower, to a certain extent, in comparison with that of Example 3. These are, however, the highest winding ratios that can be wound in a stable operation for a long time under respective conditions.

EXAMPLES 7-9

The polymer extrusion velocity $V_0$ (m/min), the distance L (cm) between the spinneret and the liquid surface of the liquid cooling apparatus, the liquid flow down velocity (m/min) at the bottom of the liquid cooling apparatus, the take-up velocity $V_w$, vertical distance H (cm) from the orifice surface of the spinneret to the liquid surface of the liquid cooling apparatus, and the temperature of the cooling liquid are shown in Table 2. Except that the conditions were changed, the spun filaments were otherwise taken up under the same spinning conditions as in Example 1. The physical properties of the thus-obtained fibers are shown in Table 2.

The filaments were subjected to a further draw-heat treatment (one-stage drawing using a slit heater of 245° C.) and were evaluated for the strength and tensile modulus. The fibers having a tenacity higher than 9 g/d and those having a tensile modulus higher than 150 g/d were marked with marks and those that did not reach these values were marked with x marks. The draw ratios were 1.31, 1.25 and 1.57, respectively, in Examples 7, 8 and 9.

COMPARATIVE EXAMPLES 8-10

A polyethylene terephthalate having an intrinsic viscosity IV of 1.0 was extruded at a spinning temperature of 310° C. through a spinneret (24 spinning orifices, with an orifice diameter of 0.4) at an extrusion velocity ($V_0$) at the orifice of 10.7 m/min. The resulting filaments were air-quenched at 20° C. and were taken up under the respective conditions shown in Table 2, and were drawn at a natural draw ratio. The physical properties of the thus-obtained fibers are shown in Table 2.

Incidentally, the fibers thus obtained were subjected to a further draw-heat treatment (one-stage drawing using a slit heater of 245° C.) and were evaluated for the strength and tensile modulus. The fibers having a strength higher than 9 g/d and those having a tensile modulus higher than 150 g/d were marked with marks and those that did not reach these values were marked with x marks. The draw ratios were 2.97, 3.08 and 2.85, respectively, in Comparative Examples 8, 9 and 10.

COMPARATIVE EXAMPLE 11

A polyethylene terephthalate having an intrinsic viscosity IV of 1.0 was extruded at 310° C. through a spinneret (24 spinning orifices, with an orifice diameter of 0.4 mm) at an extrusion velocity $V_0$ at the orifice of 10.7 m/min. The resulting filaments were cooled with an air-quench at 20° C., and without being heat-drawn, were taken-up at a take-up velocity of 3300 m/min. The physical properties of the thus-obtained fibers are shown in Table 2.

Incidentally, the resulting fibers were subjected to a further draw-heat treatment (two-stage draw at 150° C. and 240° C. respectively using two slit heaters with the first draw ratio of 2.01 and second draw ratio of 1.09). The resulting fibers were evaluated for the strength and tensile modulus. The fibers having a tenacity higher than 9 g/d and those having a tensile modulus higher than 150 g/d were marked with marks and those that did not reach these values were marked with x marks.

COMPARATIVE EXAMPLES 12–13

A polyethylene terephthalate having an intrinsic viscosity IV of 1.0 was extruded through a spinneret (24 spinning orifices, with an orifice diameter of 0.4 mm) at a spinning temperature of 310° C. and at an extrusion velocity $V_0$ at the orifice of 10.7 m/min. The resulting filaments were cooled with an air-quench at 20° C. and taken-up under the conditions shown in Table 2, and hot-drawn at 80° C. under a natural draw ratio. The physical properties of the thus-obtained fibers are shown in Table 2.

Incidentally, the resulting fibers were subjected to a further drawing treatment. The resulting fibers were evaluated for the strength and tensile modulus. The fibers having a tenacity higher than 9 g/d and those having a tensile modulus higher than 150 g/d were marked with marks and those which did not reach these values were marked with x marks.

COMPARATIVE EXAMPLE 14

The filaments were spun and taken up under the same spinning conditions as in Example 1 except that the polymer extrusion velocity $V_0$ was 14.3 m/min, the distance L between the spinneret and the liquid surface of the liquid cooling apparatus was 30 cm, the liquid flow down velocity at the bottom of the liquid cooling apparatus was 2000 m/min, the take-up velocity was 5500 m/min, the vertical distance H from the liquid surface of the liquid cooling apparatus to the bottom of the liquid was 10 cm, and the temperature of the cooling liquid was 25° C. Although a specimen for the determination of the physical properties could be collected somehow, it was impossible to stably spin and wind. The properties of the thus obtained fibers are shown in Table 2.

Incidentally, the thus-obtained fibers are subjected to a further draw-heat treatment (one-stage draw with a ratio of 1.22 and by the use of a slit heater of 245° C.), and the drawn fibers were evaluated for the strength and tensile modulus. The fibers which had a tenacity higher than 9 g/d and those having a tensile modulus higher than 150 g/d were marked with marks , and those that did not attain these values were marked with marks x.

TABLE 1

| | Total denier D (d) | Tenacity DT (g/d) | Elongation at break DE (%) | Tensile modulus IS (g/d) | Remarks |
|---|---|---|---|---|---|
| Example 3 | 42.9 | 11.31 | 7.4 | 171.3 | |
| Comparative Example 1 | 47.1 | 10.41 | 7.9 | 150.3 | 1st (outermost) 1/5 layer* |
| Comparative Example 2 | 46.3 | 10.61 | 7.8 | 155.3 | 2nd 1/5 layer* |
| Comparative Example 3 | 45.7 | 10.66 | 7.8 | 160.2 | 3rd 1/5 layer* |
| Comparative Example 4 | 46.2 | 10.72 | 7.6 | 159.3 | 4th 1/5 layer* |
| Comparative Example 5 | 45.5 | 10.99 | 7.6 | 160.7 | 5th (innermost) 1/5 layer* |
| Comparative Example 6 | 38.7 | 8.24 | 6.9 | 148.1 | |
| Example 4 | 43.8 | 11.10 | 7.6 | 170.5 | Wound package shape: good |
| Comparative Example 7 | — | — | — | — | Impossible to wind-up |
| Example 5 | 43.4 | 11.16 | 7.6 | 160.4 | |
| Example 6 | 44.3 | 11.02 | 7.5 | 161.5 | Some filamentation |

*Refer to page 21.

TABLE 2

| | Intrinsic viscosity IV of the polymer | Polymer extrusion velocity $V_0$ (m/min) | Take-up velocity $V_w$ (m/min) | Height H (cm) of the cooling liquid | Length L (cm) from the spinneret orifices to the cooling liquid surface | liquid flow down speed (m/min) |
|---|---|---|---|---|---|---|
| Example 7 | 1.00 | 10.7 | 3900 | 10 | 30 | 1800 |
| Example 8 | 1.00 | 14.3 | 4500 | 10 | 30 | 2000 |
| Example 9 | 1.00 | 10.7 | 3000 | 10 | 30 | 1600 |
| Comparative Example 8 | 1.00 | 10.7 | 2000 | / | / | / |
| Comparative Example 9 | 1.00 | 10.7 | 2500 | / | / | / |

TABLE 2-continued

| | | | | | | |
|---|---|---|---|---|---|---|
| Comparative Example 10 | 1.00 | 10.7 | 1500 | / | / | / |
| Comparative Example 11 | 1.00 | 10.7 | 3300 | / | / | / |
| Comparative Example 12 | 1.00 | 10.7 | 2500 | / | / | / |
| Comparative Example 13 | 1.00 | 10.7 | 3000 | / | / | / |
| Comparative Example 14 | 1.00 | 14.3 | 5500 | 10 | 30 | 2000 |
| Reference Example 1 | 0.65 | | | | | |
| Reference Example 2 | 0.65 | | | | | |

| | | Properties of as-spun filaments | | | Evaluation of drawn filaments | |
|---|---|---|---|---|---|---|
| | Cooling liquid temp. (°C.) | Birefringence Δn | Specific gravity SG | δΔn (× $10^{-3}$) | Strength | Initial modulus |
| Example 7 | 25 | 0.164 | 1.352 | 14.0 | O | O |
| Example 8 | 25 | 0.162 | 1.354 | 11.7 | O | O |
| Example 9 | 25 | 0.117 | 1.343 | 7.0 | O | O |
| Comparative Example 8 | (20: air) | 0.077 | 1.342 | 2.1 | x | x |
| Comparative Example 9 | (20: air) | 0.072 | 1.348 | 2.0 | x | O |
| Comparative Example 10 | (20: air) | 0.121 | 1.353 | 4.0 | x | x |
| Comparative Example 11 | (20: air) | 0.076 | 1.362 | 4.0 | x | x |
| Comparative Example 12 | (20: air) | 0.097 | 1.348 | 3.5 | x | x |
| Comparative Example 13 | (20: air) | 0.083 | 1.358 | 4.1 | x | x |
| Comparative Example 14 | 25 | 0.153 | 1.361 | Measurement impossible | x | x |
| Reference Example 1 | | 0.169 | 1.368 | | x | x |
| Reference Example 2 | | 0.158 | 1.368 | | x | O |

Reference Examples 1-2 are described in Kobunshi Ronbunshu vol. 42, No. 3, pp 159-166 (Mar. 1985) and quoted for comparison.

Since the present invention is composed as mentioned above, the invention provides, as apparent from the above mentioned Examples, a process which makes it possible to stably spin filaments of high orientation, never seen before, but of low crystallinity. Furthermore, the invention provides a high productivity process for stably improving physical properties of polyester fibers from said filaments, using a production apparatus for improving such filaments.

What we claim is:

1. A process for the production of polyester fibers which comprises melt-spinning an ethylene terephthalate polyester to form highly oriented low crystalline polyester filaments which, at the stage of being taken-up and prior to being drawn, have a birefringence (Δn) and specific gravity (SG) within the below indicated ranges (a) and (b), and then, without winding-up, subjecting the said filaments immediately to drawing and heat treatment between first godet rolls and second godet rolls under a draw ratio (DR) defined by the following formulas:

$$\Delta n \geqq 5SG - 6.64 \quad (a)$$

$$\Delta n \geqq 0.100 \quad (b)$$

$$2.0 \geqq DR > 1.0 \quad (c),$$

and then winding up the drawn filaments.

2. The process as claimed in claim 1 wherein the highly oriented low crystalline polyester filaments are produced by melt-spinning an ethylene terephthalate polyester having an intrinsic viscosity (IV) of not lower than 0.8 through a spinneret to form filaments, which are passed through a liquid cooling apparatus and then taken-up, under those conditions satisfying the following process requirements:

(1) the distance L (cm) between the spinneret I and the liquid surface of the liquid cooling apparatus 3 is ≦ filament solidification point − 5, wherein the filament solidification point is a value determined by filament diameter measurement according to on-line measurement of filament diameter change of filaments spun under air quenching conditions of 20° C., 65% RH and 0.3 m/sec.;

(2) the liquid flowing down speed (m/min) at the lower end of the liquid cooling apparatus $3 \geqq V_w/60$ wherein $V_w$ is the take-up velocity (m/min) of the filaments;

(3) the take-up speed is $V_0$ (m/min) $\geqq V_o \times 200$, wherein $V_o$ is the extrusion velocity (m/min) of the polyester from the spinneret 1;

(4) the vertical distance H (cm) from the liquid surface of the cooling apparatus to the bottom of the liquid is ≧5 cm; and (5) the liquid temperature of the liquid cooling apparatus is ≦50° C.

3. The process according to claim 1 or 2 wherein the first godet rolls are kept at a temperature of from 5° C. to 60° C.

4. The process according to claim 1 or 2 wherein drawing and heat treatment is conducted in a heating zone provided between the first godet rolls and second godet rolls.

5. The process according to claim 1 or 2 wherein the drawn filaments, prior to being wound-up, are subjected to relaxation treatment with a relaxation ratio of 15% or less.

* * * * *